US010468847B2

(12) United States Patent
Frenken

(10) Patent No.: US 10,468,847 B2
(45) Date of Patent: Nov. 5, 2019

(54) HYDRAULICALLY ACTUATABLE CRIMPING DEVICE, METHOD FOR CARRYING OUT A CRIMPING OPERATION, METHOD FOR PRODUCING AN ELECTROCONDUCTIVE COMPRESSION JOINT, ELECTROCONDUCTIVELY CRIMPED COMPRESSION SLEEVE, METHOD FOR CLAMPING A WORKPIECE AND HYDRAULIC DEVICE

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 811 days.

(21) Appl. No.: 14/759,765

(22) PCT Filed: Jan. 6, 2014

(86) PCT No.: PCT/EP2014/050075
§ 371 (c)(1),
(2) Date: Jul. 8, 2015

(87) PCT Pub. No.: WO2014/108361
PCT Pub. Date: Jul. 17, 2014

(65) Prior Publication Data

US 2015/0364889 A1 Dec. 17, 2015

(30) Foreign Application Priority Data

Jan. 9, 2013 (DE) ..... 10 2013 100 183

(51) Int. Cl.
*H01R 43/042* (2006.01)
*H01R 4/20* (2006.01)
*H01R 43/048* (2006.01)

(52) U.S. Cl.
CPC ..... *H01R 43/0427* (2013.01); *H01R 4/20* (2013.01); *H01R 43/048* (2013.01); *Y10T 29/49185* (2015.01); *Y10T 29/53226* (2015.01)

(58) Field of Classification Search
CPC .... H01R 43/0427; H01R 43/048; B21J 15/20; B25B 5/02; B25B 5/061; Y10T 29/49185; Y10T 29/53226
See application file for complete search history.

(56) References Cited

U.S. PATENT DOCUMENTS 2,863,346 A 12/1958 Cobaugh et al.
2,968,202 A * 1/1961 Evans ..... H01R 43/0427 60/481

(Continued)

FOREIGN PATENT DOCUMENTS

DE 3235040 A1 3/1984
DE 37 13 711 A1 12/1987

(Continued)

OTHER PUBLICATIONS

International Search Report for PCT/EP2014/050075 dated Jun. 24, 2014, 10 pages.

*Primary Examiner* — Livius R. Cazan
(74) *Attorney, Agent, or Firm* — Klintworth & Rozenblatz IP LLP

(57) ABSTRACT

A handheld hydraulically actuatable crimping device includes a hydraulic piston that can be displaced in a cylinder against the force of a spring. The piston is connected to a crimping part by a piston rod in order to carry out a crimping operation. The piston includes first and second partial pistons with first and second partial application faces which can be acted upon with hydraulic medium that has the same hydraulic pressure. Both partial pistons are respectively connected to a first and a second crimping part. The second crimping part can at a greater traveling distance only (Continued)

be acted upon with the second partial piston. The second crimping part can be acted upon with both partial pistons over a first partial traveling distance that is defined by the displacement of the first partial piston from its initial position up to the point, at which it reaches a stop. The first crimping part is axially covered in its entirety by the second crimping part.

9 Claims, 11 Drawing Sheets

(56) References Cited

U.S. PATENT DOCUMENTS

| | | | | | |
|---|---|---|---|---|---|
| 3,006,983 | A | | 10/1961 | McDurmont | |
| 3,154,981 | A | | 11/1964 | McDurmont | |
| 4,096,727 | A | * | 6/1978 | Gargaillo | B21D 28/002 72/312 |
| 4,365,401 | A | * | 12/1982 | Ogren | B21J 15/10 29/243.53 |
| 4,796,461 | A | | 1/1989 | Mead | |
| 5,065,609 | A | | 11/1991 | Dischler | |
| 5,174,554 | A | * | 12/1992 | Yonezawa | B25B 5/061 269/137 |
| 5,195,042 | A | | 3/1993 | Ferraro et al. | |
| 6,202,663 | B1 | | 3/2001 | Uemura | |
| 6,276,186 | B1 | | 8/2001 | Frenken | |
| 6,401,515 | B2 | | 6/2002 | Frenken | |
| 7,086,979 | B2 | | 8/2006 | Frenken | |
| 7,254,982 | B2 | | 8/2007 | Frenken | |
| 7,412,868 | B2 | | 8/2008 | Frenken | |
| 7,421,877 | B2 | | 9/2008 | Frenken | |
| 2002/0148089 | A1 | | 10/2002 | Frenken | |
| 2010/0300308 | A1 | | 12/2010 | Frenken | |

FOREIGN PATENT DOCUMENTS

| | | | |
|---|---|---|---|
| WO | 99/04165 | | 1/1999 |
| WO | 99/19947 | | 4/1999 |
| WO | 02/00368 | A2 | 1/2002 |
| WO | 02/95264 | A1 | 11/2002 |
| WO | 03/084719 | A1 | 10/2003 |
| WO | 2008/138987 | A2 | 11/2008 |

* cited by examiner 29
30
8
24'
31
27
24
25
26
A
28
21
23
17
d
20
a
c
b
22
19
16
18
15
14

29
30
31
27
A
24
8
26
25
28
21
23
20
22
17
19
18
16
15
14

29
30
31
27
26
28
23
A
24
25
21
8
22
20
17
19
18
16
15
14

32
30
31
A
8
27
24
25
26
28
21
23
20
22
17
19
18
16
15
14

32
30
A
31
27
24
8
25
26
28
21
23
22
20
17
19
18
16
15
14

32
30
31
27
A
8
24
25
26
21
28
23
20
22
17
19
18
16
15
14

HYDRAULICALLY ACTUATABLE CRIMPING DEVICE, METHOD FOR CARRYING OUT A CRIMPING OPERATION, METHOD FOR PRODUCING AN ELECTROCONDUCTIVE COMPRESSION JOINT, ELECTROCONDUCTIVELY CRIMPED COMPRESSION SLEEVE, METHOD FOR CLAMPING A WORKPIECE AND HYDRAULIC DEVICE

BACKGROUND

The invention furthermore relates to a compression sleeve that is electroconductively crimped to two cables in opposite regions referred to a longitudinal direction of the compression sleeve and on an outer side has two die impressions realized adjacent to one another over the length of the compression sleeve.

The invention also relates to a method for clamping a workpiece in a hydraulic device, preferably a handheld crimping device, with a displaceable die that can be used as a clamping part and is driven by a hydraulic piston that can be displaced in a hydraulic cylinder against the force of a pull-back spring.

The invention furthermore relates to a hydraulic device, preferably a handheld crimping device, with a displaceable die that can be used as a clamping part and driven by a hydraulic piston that can be displaced in a hydraulic cylinder against the force of a pull-back spring.

Such crimping devices, crimping methods, methods for clamping a workpiece, methods for producing an electroconductively crimped compression sleeve, as well as hydraulic devices with a die that can be used as a clamping part, have already been disclosed in various forms. U.S. Pat. No. 2,968,202 A discloses a crimping device, in which only one partial piston acts upon a first crimping part during a displacement along a first partial traveling distance. Comparable prior art is also known from U.S. Pat. Nos. 2,863,346 A, 4,365,401 A and WO 02/00368 A2.

Crimping devices and crimping methods of this type are preferably used for compressing or crimping cable lugs with inserted cables. In a known crimping device disclosed in DE-A1-3235040, the contact between the crimping part and a workpiece triggers a limitation of the further traveling distance of the crimping part such that the crimping part can only be additionally displaced from the position, at which it comes in contact with the workpiece, by a certain distance. In this way, workpieces of different sizes can be crimped in an approximately uniform fashion. However, it can occur that a workpiece, which has already been crimped once, is subjected to a second crimping operation. In such instances, the crimping part also is once again displaced by a predefined distance after it comes in contact with the workpiece such that the workpiece may ultimately be destroyed. In addition, the compressive force is always identical. Consequently, smaller workpieces are typically crimped with an excessive compressive force. This may ultimately also lead to the destruction of a workpiece.

Another crimping tool is known from U.S. Pat. No. 5,195,042. In order to ensure proper crimping, a pressure sensor is provided in this case and the maximum traveling distance of the crimping part is furthermore controlled. Although a higher compressive force can be exerted upon larger workpieces to be crimped and a lower compressive force can be exerted upon smaller workpieces to be crimped, this is only possible as a function of a measurement of the workpiece to be crimped and as a result of a pressure measurement by means of a pressure sensor.

According to WO 03/084719 A1 (see also U.S. Pat. No. 7,254,982 B2, U.S. Pat. No. 7,412,868 B2 and U.S. Pat. No. 7,421,877 B2), the working piston of an electrohydraulic crimping device can initially be displaced into a holding position, in which a part may be clamped, and only then displaced into a crimping position by means of an additional actuation.

The known devices and methods are to some extent not satisfactory because they nevertheless allow operating errors with major consequences and/or have a complicated design. There likewise is a need for advantageously carrying out a crimping operation on a sleeve and cables with different diameters, as well as for disclosing a thusly crimped compression joint. Last but not least, there is a need for advantageously and gently holding a workpiece in a hydraulic device.

SUMMARY

A crimping device in the form of a handheld device is provided The crimping device has a first crimping part can be acted upon with two partial pistons over a first partial traveling distance that is defined by the displacement of the first partial piston from an initial position up to the point, at which it reaches a stop.

The application of a higher or a lower compressive force is realized automatically during the course of the crimping operation as described in greater detail below.

A method for carrying out a crimping operation is provided. In the method, the compressive force is controlled by varying the effective application face of the piston, and the same maximum pressure is exerted upon an effective application face of a piston acting upon the crimping part irrespective of whether a final crimping position is reached in the first or the second partial traveling distance.

A method for producing an electroconductive compression joint is provided. In the method, a compression sleeve, which has a constant inside diameter over its length, is in two opposite regions referred to a longitudinal direction of the compression sleeve crimped to the cables with different diameters by twice acting upon the compression sleeve from outside with the same die, but with a different compressive force, namely at locations that lie adjacent to one another over the length of the compression sleeve and are respectively assigned to an end region of the cable with larger diameter to be crimped and an end region of the cable with smaller diameter to be crimped, wherein the cable with smaller diameter is crimped with a lower compressive force due to the fact that two partial pistons, the partial application faces of which differ in size, are arranged in the same hydraulic cylinder and acted upon with the same hydraulic pressure, wherein the second partial piston can be displaced relative to the first partial piston by a distance c and the first partial piston can be displaced relative to the hydraulic cylinder, which is fixed with respect to the housing, by a distance d such that the second partial piston can be displaced by the distance c+d and both partial pistons are able to jointly act upon the second crimping part over a first partial traveling distance corresponding to the distance d whereas the second crimping part can only be acted upon with the second partial piston when processing workpieces that allow the crimping part to travel a greater distance than the first partial traveling distance, and wherein both partial pistons furthermore are respectively connected to a first and a second crimping part and the first crimping part is axially covered in its entirety by the second crimping part.

With respect to the utilization, the cables have different diameters, the die impressions are identical, and the die impressions respectively are produced in the compression sleeve with different depths due to the application of different compressive forces for crimping the cable of larger cross section on the one hand and the cable of smaller cross section on the other hand, and a die impression assigned to the cable with smaller diameter is produced in the compression sleeve deeper than a die impression assigned to the cable with larger diameter.

A method for clamping a workpiece is provided. In the method, a first and a second clamping part are provided, and that a first and a second partial piston are provided and can be displaced relative to one another in a telescoping fashion in a common hydraulic cylinder against the force of a respective pull-back spring, wherein the first partial piston in any case displaces the first clamping part in order to clamp the workpiece, wherein both partial pistons furthermore are simultaneously displaced as far as a clamping position, which results in clamping of the workpiece, such that the first partial piston leads the second partial piston when the partial pistons are acted upon with hydraulic medium, and wherein the displacement of the partial pistons is stopped in the clamping position.

A hydraulic device is provided. In the hydraulic device, a first and a second clamping part are provided, and that a first and a second partial piston are provided and can be displaced relative to one another in a telescoping fashion in a common hydraulic cylinder against the force of a respective pull-back spring, wherein the first partial piston in any case displaces the first clamping part in order to clamp the workpiece, wherein both partial pistons furthermore are displaced as far as a clamping position, which results in clamping of the workpiece, such that the first partial piston leads the second partial piston when the partial pistons are acted upon with hydraulic medium and the displacement of the partial pistons is stopped in the clamping position, and wherein the fact that only one of the partial pistons or a corresponding clamping or crimping part contacts the workpiece enables this contacting crimping or clamping part to elastically yield during a certain movement of the workpiece because a pressure compensation referred to the other partial piston, which in this case can slightly spring back due to its pull-back spring, takes place via the hydraulic medium.

With respect to the crimping device, the partial pistons are guided inside of one another in a telescoping fashion. Accordingly, one partial piston is only assigned to an inner region whereas the other partial piston is only assigned to an outer region. This may also apply to the crimping parts moved by the partial pistons.

It is furthermore preferred that the first partial piston forms a second hydraulic cylinder for the second partial piston. The second partial piston is sealed and moved relative to the cylindrical interior of the first partial piston. The second partial piston can be displaced relative to the first partial piston and also displaced relative to the first hydraulic cylinder, in which both partial pistons are jointly accommodated.

A separate crimping part, i.e. a first and a second crimping part, is preferably assigned to each of the pistons.

It is furthermore preferred that the first crimping part can be acted upon with both partial pistons over a section of the traveling distance, preferably a traveling distance that corresponds to the aforementioned first partial traveling distance. If the first partial application face is larger than the second partial application face in accordance with another preferred enhancement, the first partial piston will lead the second partial piston within the first partial traveling distance. In this respect, it is proposed that the second crimping part assigned to the second partial piston can be acted upon with the first crimping part assigned to the first partial piston over a first traveling distance, preferably the aforementioned first partial traveling distance. For this purpose, said crimping parts may be realized in an approximately form-fitting fashion. If the second crimping part forms a stopping face for the first crimping part and the first crimping part is moved in an overriding fashion in the described constellation, the second crimping part and consequently also the second partial piston are thereby inevitably carried along as well.

It would also be possible that the second partial piston can be displaced farther forward than the first partial piston referred to the first hydraulic cylinder, i.e. the hydraulic cylinder, in which both partial pistons are ultimately accommodated although the second piston merely is indirectly accommodated in the first hydraulic cylinder by means of the first partial piston. Consequently, the second partial piston can be displaced beyond the first partial piston and the assigned second crimping part can continue to move relative to the first crimping part that remains stationary, particularly over the aforementioned second partial traveling distance.

With respect to the partial application faces, it would be conceivable that the first partial application face is smaller than the second partial application face, as well as that the first partial application face is larger than the second partial application face as primarily discussed above. If the first partial application face is smaller than the second partial application face and the restoring force of the pull-back springs acting upon the first and second partial piston also is identical or chosen such that no adverse effects arise, the second partial piston is initially displaced forward upon an actuation. Once the second crimping part acted upon with the second partial piston contacts a workpiece, the first crimping part, which is not yet in contact with the workpiece, is displaced farther forward, if applicable, until both crimping parts jointly act upon the workpiece or the first crimping part can no longer be displaced forward because the end of the first partial traveling distance has been reached.

Both partial pistons are respectively acted upon with a separate first and second pull-back spring. These pull-back springs may also be realized differently with respect to their restoring force.

When the hydraulic crimping device is actuated, it would also be conceivable that a displacement of the first and the second partial piston or an action thereupon with hydraulic medium as such only takes place until a certain first force is generated or, for example, as long as a control button is pressed. Once the first force is reached or the control button is released, no additional hydraulic medium is supplied into the first hydraulic cylinder such that the crimping parts are not displaced further. This can be utilized, for example, for initially clamping a workpiece, but not yet or at least not yet completely crimping said workpiece. In this context, the design of the hydraulic piston in the form of two partial pistons causes one partial piston to be movable against a spring force in such a holding position. For example, if the second partial piston is in clamping contact with a workpiece, but the first partial piston has not yet reached the end of the first partial traveling distance, a pressure increase in the hydraulic medium is initiated when the second crimping part is acted upon with pressure, wherein this can cause a movement of the first partial piston against its pull-back spring if the first crimping part is not in contact with the workpiece as presently assumed.

The crimping part may consist, in particular, of a crimping die.

The two crimping parts, i.e. the first and the second crimping part, may complement one another and form a complete crimping die. In this case, the second crimping part may form a central region of the complete crimping die and the first crimping part may form an outer region of the complete crimping die.

With respect to the method, it is furthermore preferred that the same maximum pressure is exerted upon an effective application face of a piston acting upon the crimping part irrespective of whether a final crimping position is reached in the first or the second partial traveling distance. Accordingly, this is also the case, in particular, if the hydraulic piston consists of two partial pistons as described above in an exemplary fashion with reference to an embodiment of a device for carrying out this method.

It is also preferred to control the compressive force by varying the effective application face of the piston. It is likewise preferred, in particular, to control the compressive force without sensors and furthermore preferred to exclusively realize the control by means of the aforementioned variation of the effective piston application face.

The preceding and following explanations with respect to the crimping device also apply to the hydraulic device of a more general type that merely serves, e.g., for clamping a workpiece. It may consist, for example, of a hydraulic ram that only acts upon one side of a workpiece, the other side of which is supported by a supporting surface (independently of the hydraulic device or another hydraulic ram).

BRIEF DESCRIPTION OF THE DRAWINGS

The invention is described in greater detail below with reference to the attached drawings that, however, merely show an exemplary embodiment.

In these drawings.

DETAILED DESCRIPTION

Figure 1:
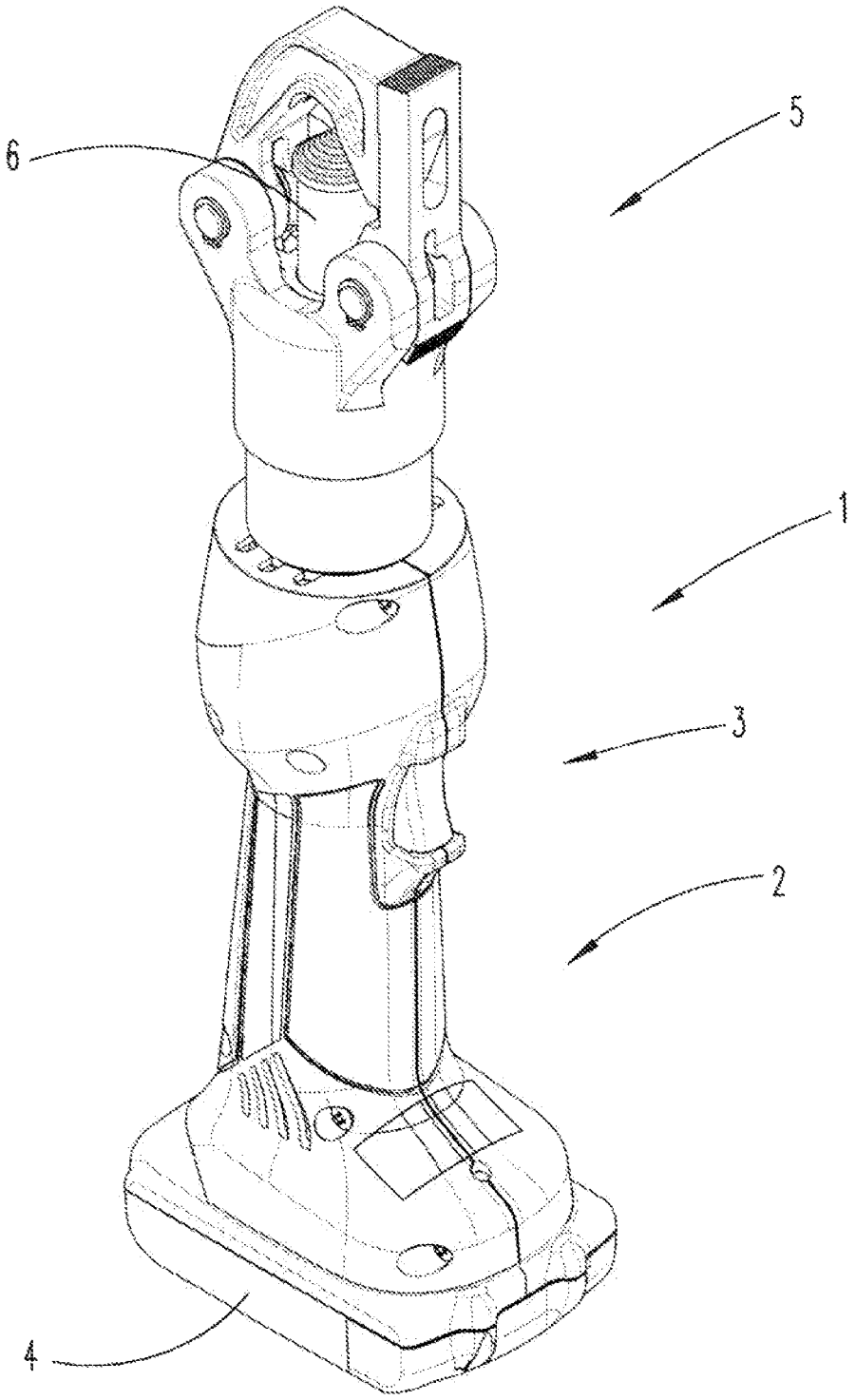
FIG. 1 shows a perspective view of a crimping device.

A crimping device 1 in the form of a hand tool is illustrated in the figures and described below. The crimping device 1 has a handle region 2 with a length that is approximately adapted to the width of a hand. A control switch 3 is assigned to the handle region.

The crimping device 1 shown consists of an electrohydraulically actuatable crimping device 1 with an accumulator 4. The accumulator 4 is arranged opposite to a working end 5 of the crimping device. The crimping device 1 shown in FIG. 1 has an altogether elongate shape similar to a rod.

It could alternatively also consist of a cable-bound crimping head. The control device could also be arranged distal referred to the crimping head.

Figure 2:
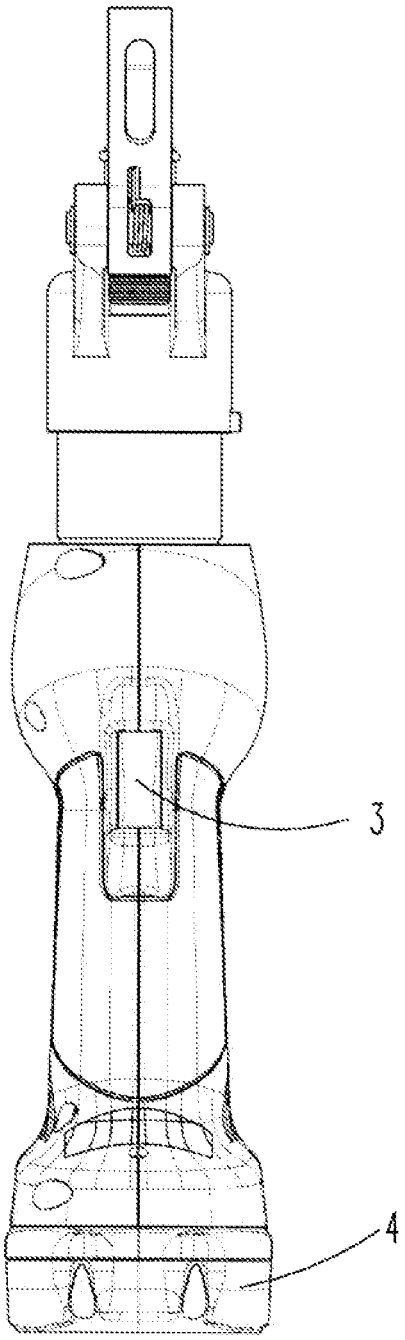
FIG. 2 shows a view relating to a narrow side.
Figure 3:
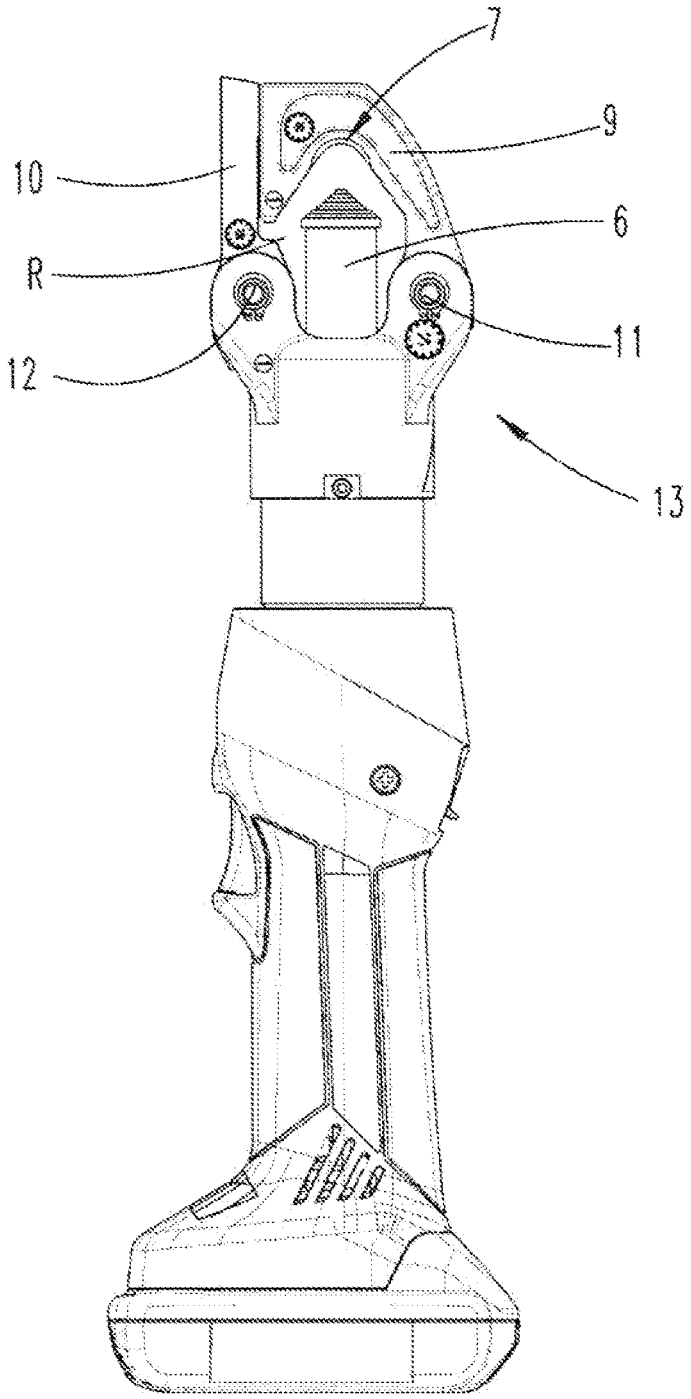
FIG. 3 shows a view relating to a broad side.

According to FIG. 1, as well as FIGS. 2 and 3, the crimping device 1 also features a crimping part 6 that is realized in the form of a crimping die in the exemplary embodiment shown.

The crimping device 1 furthermore features a counterstop element 7, against which a workpiece to be crimped can be placed as illustrated, e.g., in FIG. 3.

The counterstop element 7 in the exemplary embodiment shown forms a section of a first pivoting part 9 that can be interlocked with a second pivoting part 10, wherein both pivoting parts are respectively arranged on a device head 13 by means of pivot joints 11, 12 such that the closed—but laterally open—device configuration illustrated in FIG. 3 is realized in the device head 13.

Figure 4:
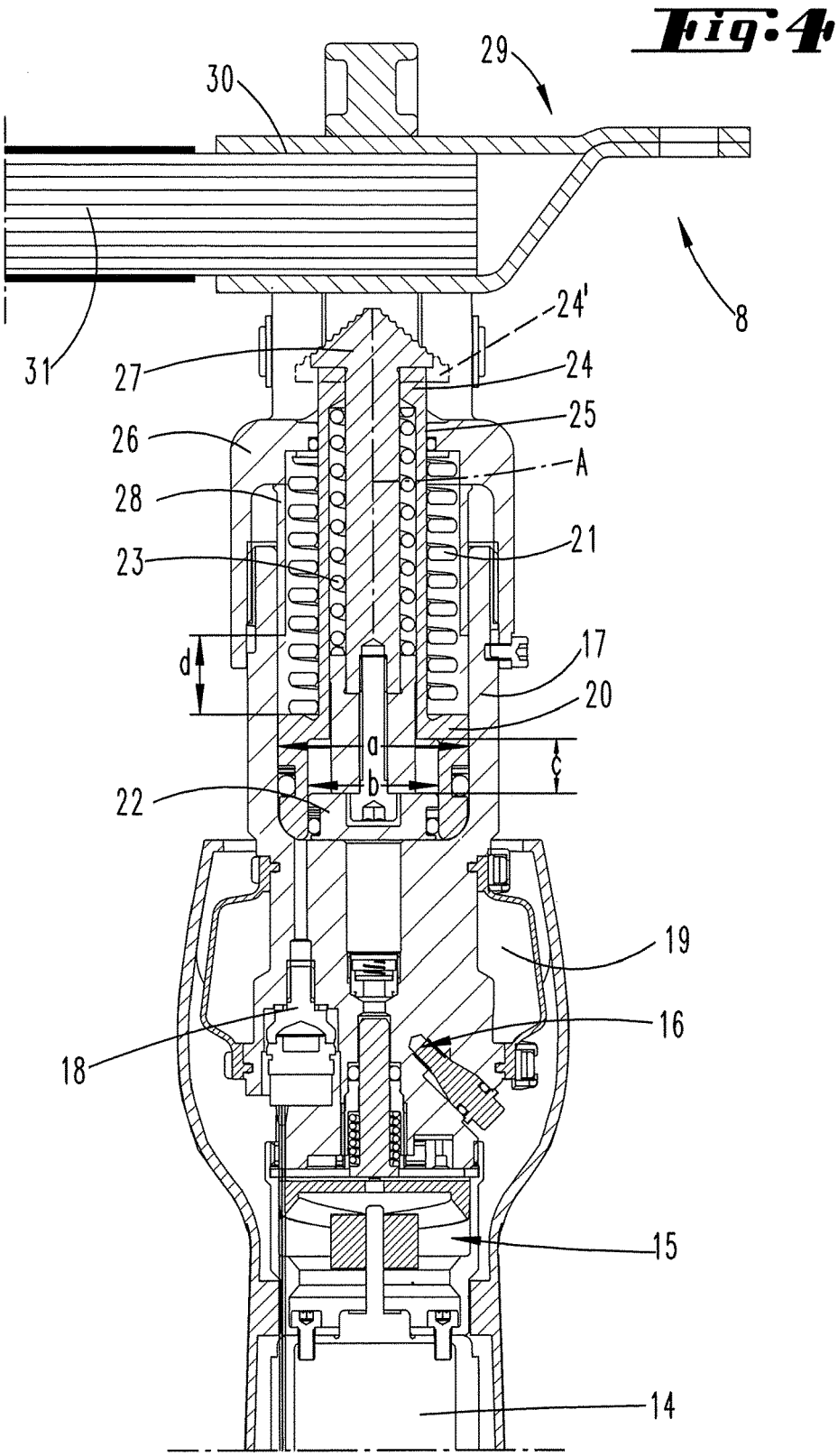
FIG. 4 shows a cross section through the crimping device in the upper region with a large workpiece inserted therein.

The cross-sectional illustration according to FIG. 4 furthermore shows that the crimping device 1 features an electric motor 14 that is not illustrated in greater detail and preferably acts upon a pump 16 via a gear 15. A hydraulic medium, which preferably consists of hydraulic oil in this case, can be pumped into a cylinder chamber formed in a first hydraulic cylinder 17 by means of the pump 16. The hydraulic medium is accommodated in a hydraulic medium tank 19 that preferably surrounds the pump 16, as well as a backflow valve 18, in the exemplary embodiment shown.

With respect to more detailed information on potential designs of the gear, the pump and the backflow valve, we refer to WO-A1 02/95264 (U.S. Pat. No. 7,086,979 B2), WO-A1 99/04165 (U.S. Pat. No. 6,202,663 B1) and WO-A1 99/19947 (U.S. Pat. No. 6,276,186 B1, U.S. Pat. No. 6,401,515 B2).

The first hydraulic piston 20 is accommodated in the first hydraulic cylinder 17. The first hydraulic cylinder 17 has a longitudinal cylinder axis A. The first hydraulic piston 20 can be displaced axially to the longitudinal cylinder axis A.

The first hydraulic piston 20 can also be returned into its initial position illustrated in FIG. 4 by means of a first pull-back spring 21 when the hydraulic pressure drops or the hydraulic medium is discharged.

The first hydraulic piston 20 also has a first application face that results from the difference between the outside diameter a and the inside diameter b of the first hydraulic piston 20.

The first hydraulic piston 20 is realized in the form of a partial piston and guides a second hydraulic piston 22 in its interior, namely centrally in its interior in the exemplary embodiment shown. The second hydraulic piston 22 has its own partial application face that is defined by the diameter b. Accordingly, the partial application faces preferably are respectively realized circularly and annularly in the exemplary embodiment. After a crimping operation has been completed, a second pull-back spring 23 makes it possible to return the second hydraulic piston 22, which is also referred to as second partial piston, into its initial position in the same fashion as already described in principle above with reference to the first hydraulic piston 20.

The first hydraulic piston 20 is connected to a first crimping part 24. In the exemplary embodiment, the first crimping part 24 is realized such that it respectively extends out of a through-opening 25 in a cylinder bottom part 26 and also protrudes therefrom in the non-actuated state. The second partial piston 22 likewise continues in the form of a piston rod, the other end of which is even in the unused state free-standing in the circumferentially closed crimping space R—as preferred in the exemplary embodiment shown—in the form of a second crimping part 27; see, e.g., FIG. 3.

In the exemplary embodiment, the first crimping part 24 is axially covered in its entirety by the second crimping part 27. In an alternative embodiment indicated with broken lines 24' in FIG. 4 (but not illustrated for other figures), the first crimping part 24 may also protrude over the second crimping part 27 transverse to the cylinder axis A and, for example, fit together with the second crimping part 27 in a nested fashion as shown in the initial state according to FIG. 4.

The two partial pistons 20 and 22 are guided inside of one another in a telescoping fashion. In this respect, it is proposed, in particular, that the second partial piston 22 with respect to its second piston rod protrudes over the first partial piston 20 with respect to its first piston rod in the initial position illustrated, e.g., in FIG. 4.

The first partial piston 20 accordingly forms a second hydraulic cylinder for the second partial piston 22. The second partial piston 22 can be displaced relative to the first partial piston 20 by the distance c whereas the first partial piston 20 can be displaced relative to the first hydraulic cylinder 17, which is fixed with respect to the housing, by the distance d. Accordingly, the total maximum displacement of the second partial piston 22 corresponds to the sum of the distances c and d.

The distance d is defined in that a stopping part 28 extends from the cylinder bottom part 26 into the first hydraulic cylinder 17, i.e. opposite to the direction, in which partial piston is displaced when a crimping operation is carried out. This stopping part may be realized in a sleeve-like fashion as in the preferred exemplary embodiment.

Accordingly, the distance d also can be varied in a relatively simple fashion by inserting a stopping part 28 with a different length.

Both partial pistons 20, 22 can jointly act upon the second crimping part 27 over a first partial traveling distance that corresponds to the distance d. When processing workpieces 8 that allow the crimping part 27 to travel a greater distance than the first partial traveling distance—until a maximum compressive force is reached—the second crimping part 27 can then only be acted upon with the second partial piston 22.

Accordingly, the second partial piston 22 also can be displaced farther forward than the first partial piston 20, wherein the relative displacement according to the distance c is in the preferred exemplary embodiment shown smaller than the distance d for the maximum displacement of the first partial piston 20 referred to the second hydraulic cylinder that guides the second partial piston 22 and is formed by the first partial piston 20.

In the exemplary embodiment, the partial application faces defined by the dimensions a and b preferably are realized in such a way that the first partial application face assigned to the first partial piston 20 is larger than the second partial application face of the second partial piston 22.

The restoring forces of the pull-back springs, which usually and in the preferred exemplary embodiment increase about linearly with the progression of the respective first or second partial traveling distance d or c, are preferably realized such that the restoring force of the second pull back spring 23 is greater than the restoring force of the first pull-back spring 21.

Workpieces 8 of different sizes such as the cable lugs in the exemplary embodiment, which respectively have different sizes or different diameters in the crimping section, can be arranged in crimping device 1, particularly in the crimping space R in the exemplary embodiment shown. A cable lug 29 features a receptacle space 30, wherein an end of a cable 31—that is stripped of its insulation in the exemplary embodiment—is inserted into said receptacle space. The cable 31 is rigidly and electroconductively connected to the cable lug 29 by exerting a crimping action upon the receptacle space 30 of the cable lug 29 from outside.

Figure 5:
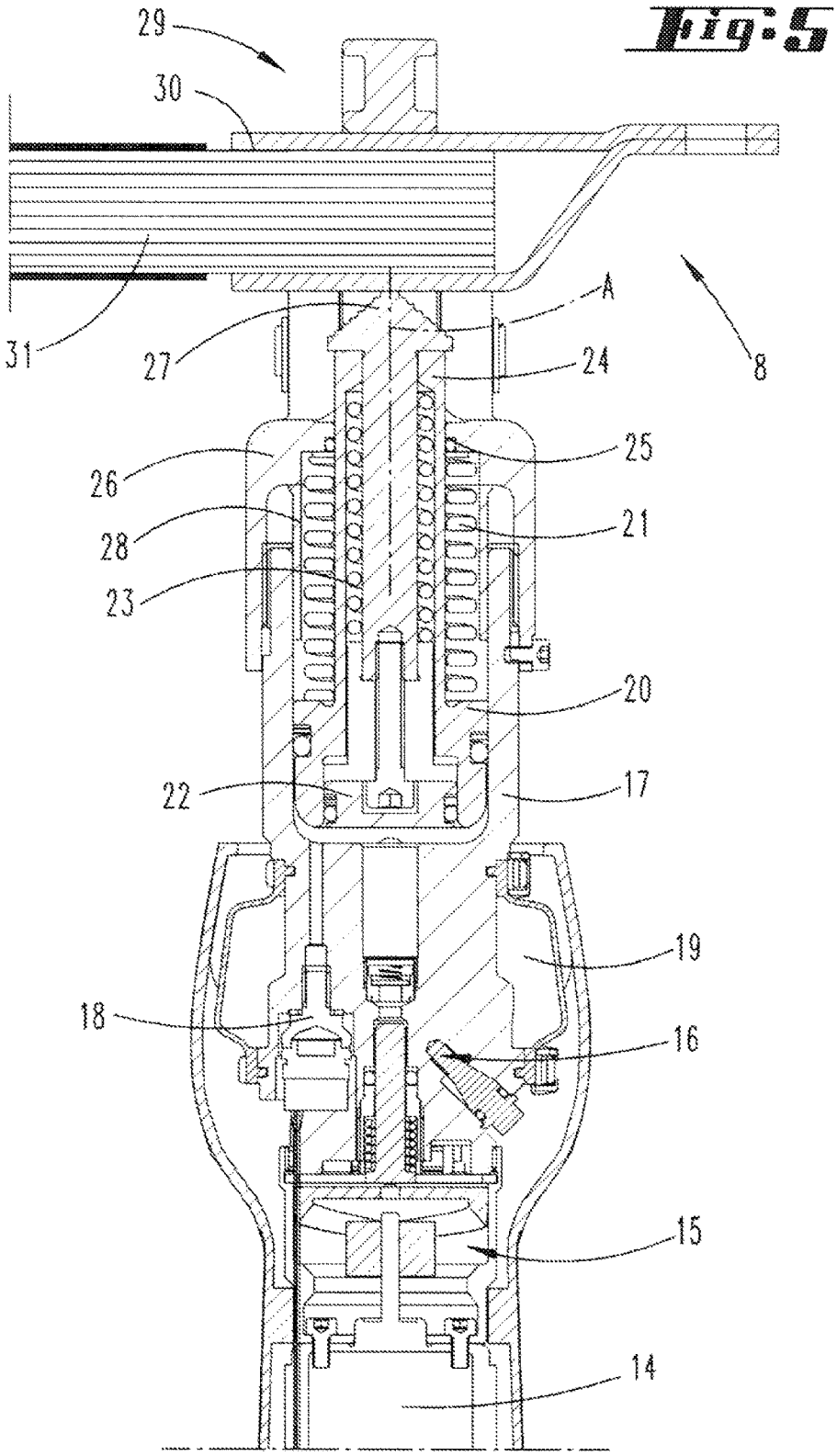
FIG. 5 shows an illustration according to FIG. 4 during a displacement of the partial piston until initial contact with the workpiece takes place.
Figure 6:
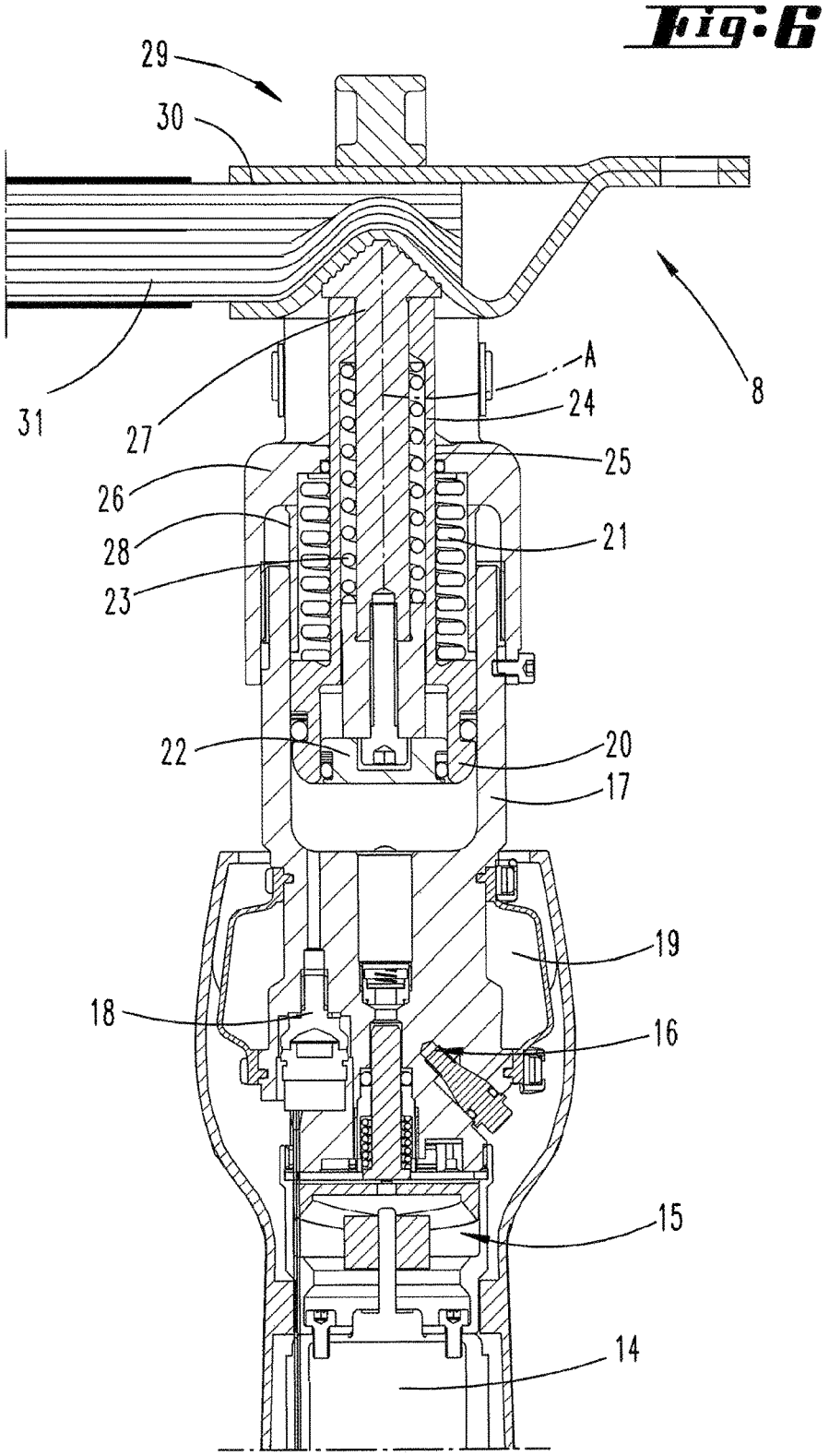
FIG. 6 shows the crimping device according to FIG. 4 when the maximum compressive force is reached.

FIGS. 4-6 show a crimping operation carried out on a cable lug that is comparatively large—referred to the outside diameter of the receptacle space 30. In the exemplary embodiment shown, a hydraulic medium, in this case hydraulic oil, is pumped into the first hydraulic cylinder 17 and, if applicable, at the same time also into the second hydraulic cylinder by means of the electric motor 14, the connected gear 15 and the pump 16 when the crimping device 1 is actuated. As the displacement of the respective first and second partial pistons 20 and 22 progresses, the pressure in the hydraulic medium chamber or cylinder chamber continuously increases due to the counterpressure generated by the pull-back springs.

A significant pressure increase occurs when the second crimping part 27 initially contacts the cable lug 29 as illustrated in FIG. 5. Since the first partial piston 20 25 has at this point not yet come in contact with the stopping part 28, both partial pistons 20, 22 continue to move in the direction of the cable lug 29 to be crimped.

The displacement of the partial pistons 20, 22 continues until a maximum compressive force is reached; see FIG. 6. In the exemplary embodiment, the maximum compressive force is defined in that the automatic backflow valve is actuated; for details in this respect, see also aforementioned publication WO-A1 99/19947 (U.S. Pat. No. 6,276,186 B1, U.S. Pat. No. 6,401,515 B2).

In deviation from this, it would also be possible, for example, to carry out a pressure measurement with respect to the pressure of the hydraulic medium in the cylinder chamber or a pressure measurement in the piston skirt of the first or second partial piston. In this case, a return movement of the hydraulic piston could be initiated as a function of the measured pressure, e.g., by opening a backflow valve, particularly in a motorized fashion.

If the backflow valve 18 was automatically actuated, i.e. displaced into the open position, based solely on the pressure of the hydraulic medium reached as it is the case in the exemplary embodiment shown, the hydraulic medium flows back, the pressure in the cylinder chamber drops and the pistons are moved back into their initial position according to FIG. 4 by the pull-back springs.

Figure 7:
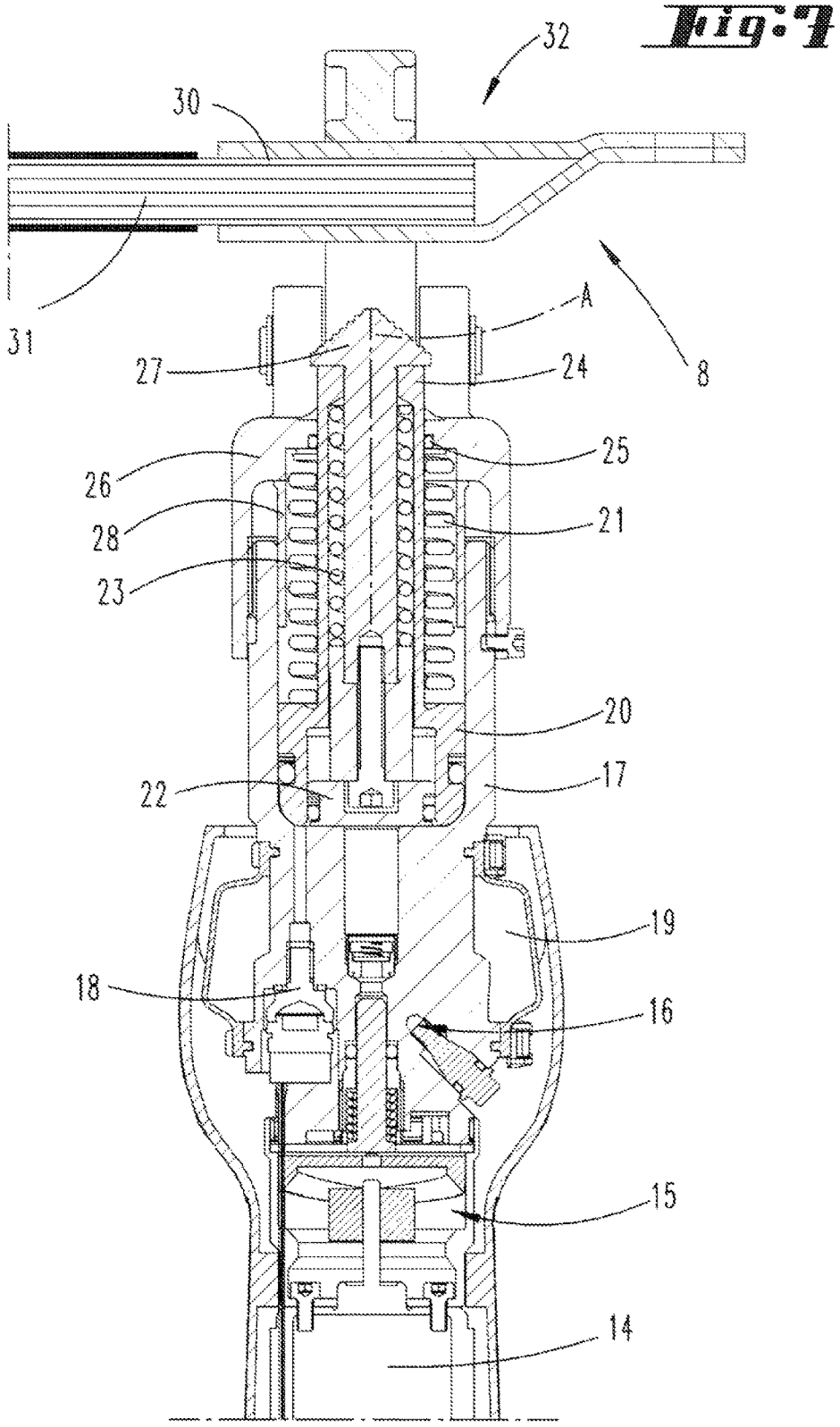
FIG. 7 shows an illustration according to FIG. 4, however, with a small workpiece.
Figure 8:
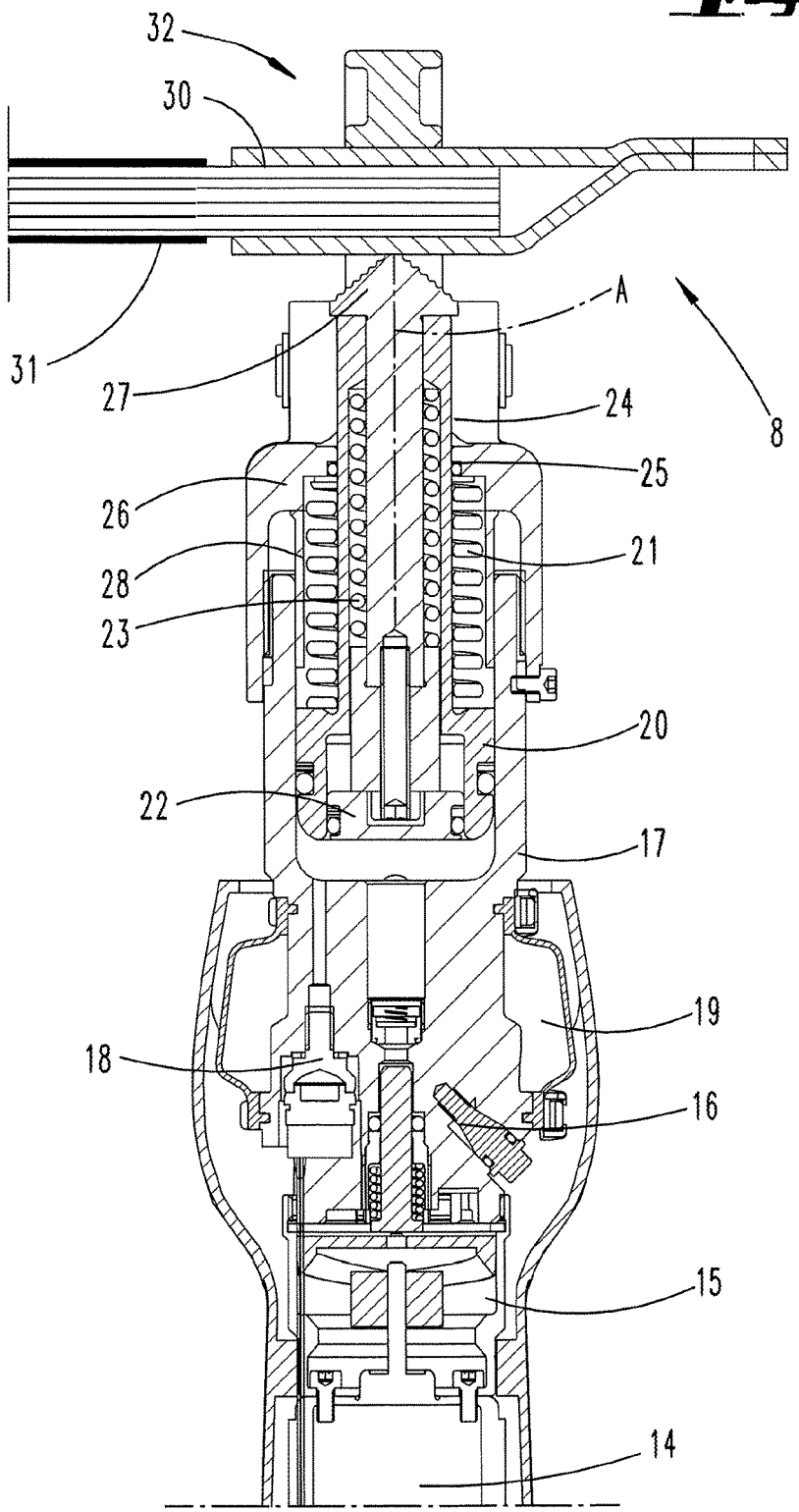
FIG. 8 shows the crimping tool with inserted workpiece according to FIG. 7 after a displacement of the partial pistons until initial contact with the workpiece takes place.
Figure 9:
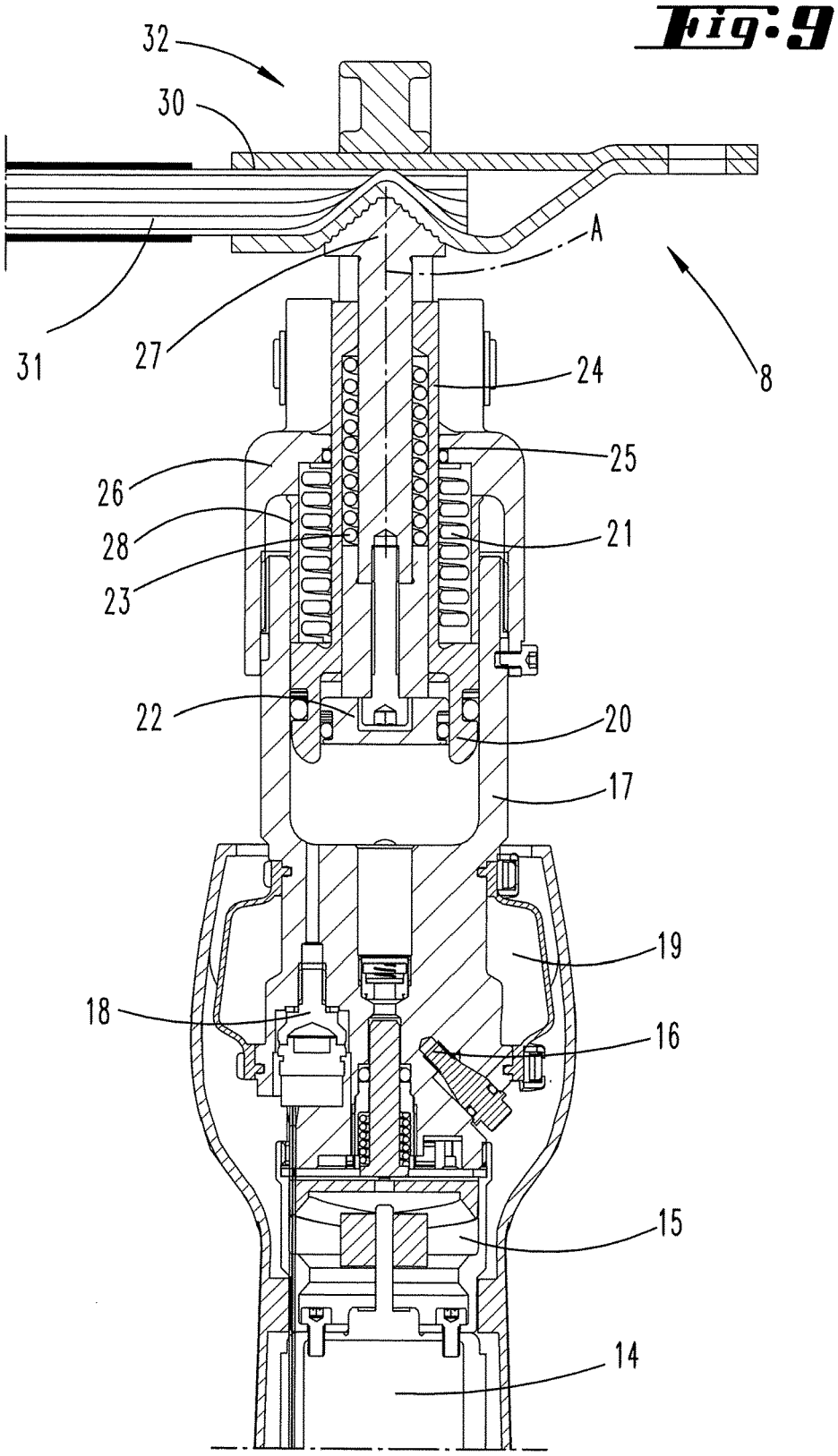
FIG. 9 shows an illustration of the crimping tool with workpiece according to FIG. 7 when the maximum compressive force is reached.

When processing a comparatively small cable lug 32 as it is the case in FIGS. 7-9, the first partial piston 20 already comes in contact with the stopping part 28 before the second crimping part 27 has reached its final crimping position (FIG. 9). As soon as the first partial piston 20 contacts the stopping part 28 during the course of such a crimping operation, the compressive force is only defined by the partial application face of the second hydraulic piston 22. In any case, the second crimping part 27 furthermore is telescopically displaced forward relative to the first crimping part 24 once the first partial piston 20 contacts the stopping part 28. However, such a telescoping movement also could already take place previously during the course of a crimping operation. This obviously also depends on the force of the pull-back springs 21, 23.

When crimping a large workpiece, in this case a large cable lug of the type illustrated in FIGS. 4-6, the crimping part is in accordance with the method displaced over a shorter traveling distance before it reaches the final crimping position than when crimping a small workpiece 8 of the type illustrated in FIGS. 7-9. A compressive force, which can be exerted by the respective crimping part 24 or 27, is accordingly controlled as a function of the position of the respective crimping part 24 or 27 along the traveling distance, particularly the position of the stopping part 28 in the exemplary embodiment shown, such that a maximum compressive force is only exerted by the crimping part 24 and/or 27 in a final crimping position within a first partial traveling distance. In the exemplary embodiment, the first partial traveling distance is defined by the traveling distance of the first hydraulic piston 20 from an initial position, for example, according to FIG. 7 to the point, at which it reaches the stop 28 as shown in FIG. 9. If the final crimping position lies within a second partial traveling distance that follows the first partial traveling distance, however, only a partial compressive force that is lower than the maximum compressive force is exerted, wherein this partial compressive force is in the exemplary embodiment defined by the partial application face of the second hydraulic piston 22 that corresponds to the dimension and is the only effective partial application face remaining at this point. At the same hydraulic pressure, the smaller application face also generates a lower force.

Figure 10:
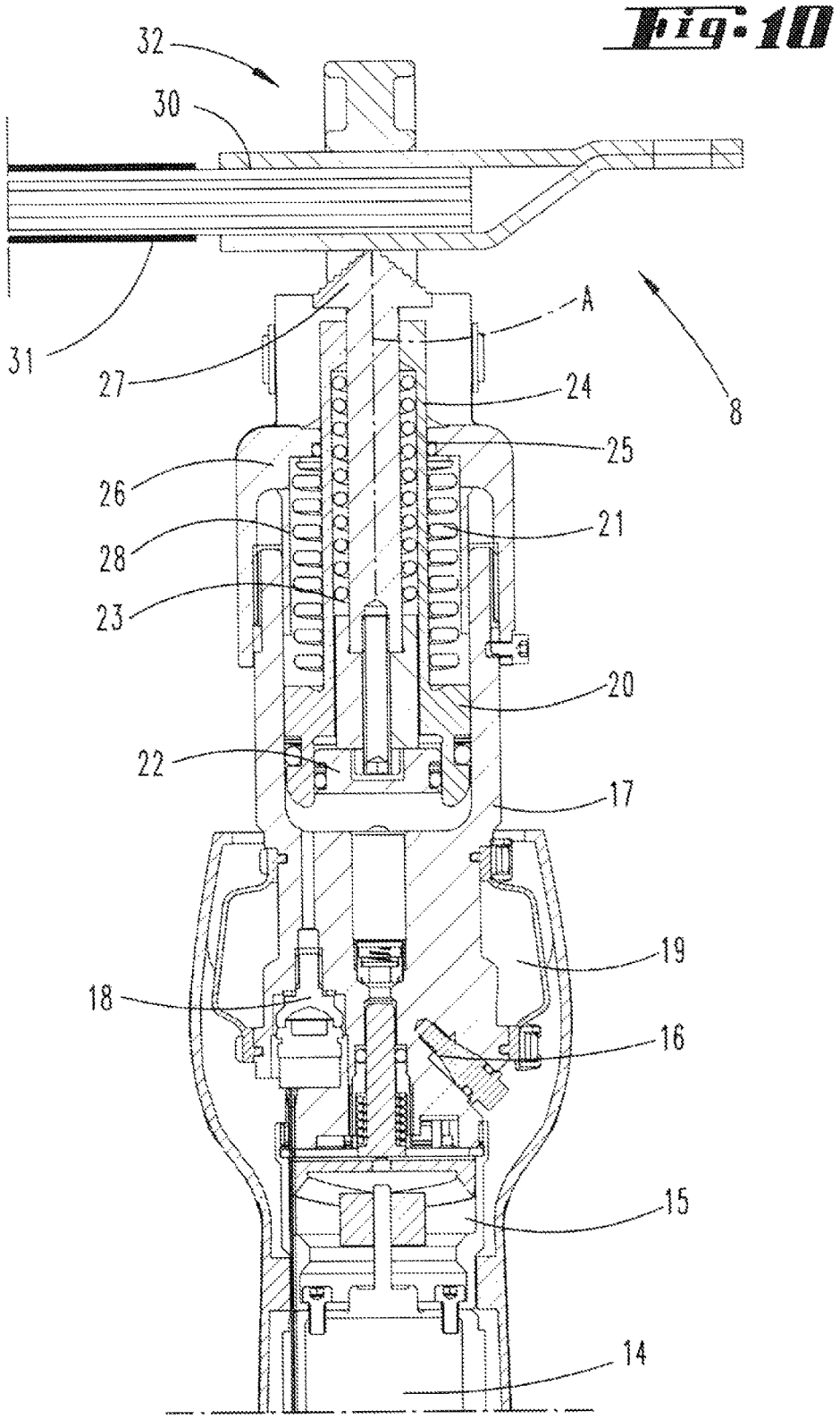
FIG. 10 shows an illustration of the hydraulic device in a clamping position referred to a workpiece.

FIG. 10 shows a hydraulic device, particularly a hydraulic crimping device of the above-described type, with a workpiece 8 clamped therein.

The second crimping part 27, which also may merely act as a clamping part in this case, is telescopically displaced forward relative to the first crimping part or clamping part 24.

The aforementioned crimping or clamping parts 24, 27 are connected to the above-described partial pistons 20, 22. Both partial pistons 20, 22 are displaced in the direction of extension by a certain distance in the common hydraulic cylinder 27, particularly such that the second partial piston 22 acting upon the second clamping part 27 leads the first partial piston 20 acting upon the first clamping part 24.

The exemplary embodiment shows that in fact only the second clamping part 27 acts upon the workpiece 8. However, it would also be conceivable that the workpiece 8 is simultaneously clamped by both clamping parts 24, 27.

The displacement of the aforementioned partial pistons or clamping pieces has been carried out to such an extent that at least the second clamping part 27 is in clamping contact with the workpiece 8 as shown in FIG. 10. In this state, the displacement of the partial pistons can be stopped, for example, by releasing a control button or, if applicable, automatically when a certain crimping pressure is reached. Subsequent crimping of the workpiece can then be carried out, for example, in response to an additional actuation. Alternatively, the clamped workpiece may also be released again in response to a special actuation, e.g. of a return button.

Figure 11:
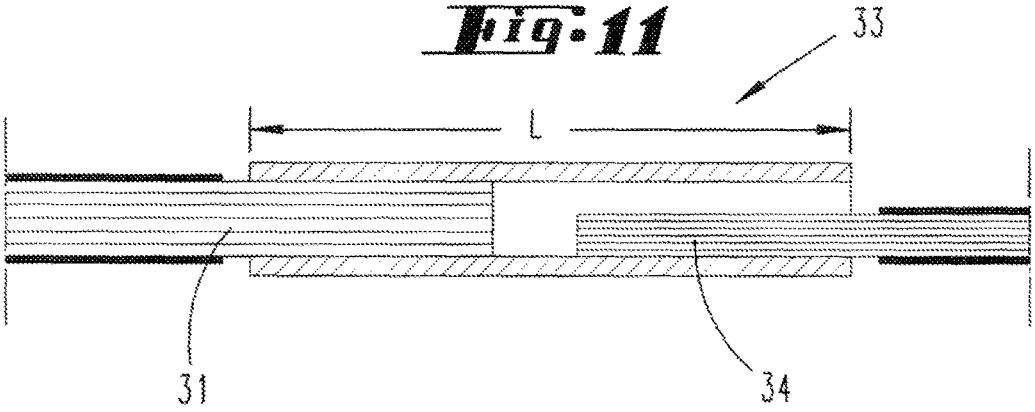
FIG. 11 shows a cross section through a compression sleeve and inserted electrical conductors with larger and smaller diameters.
Figure 12:
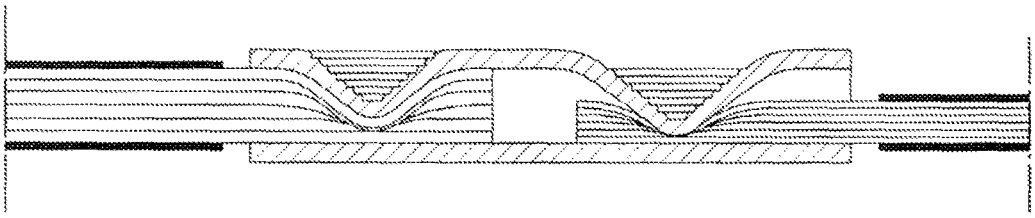
FIG. 12 shows the compression sleeve according to FIG. 11 after a crimping operation.
Figure 13:
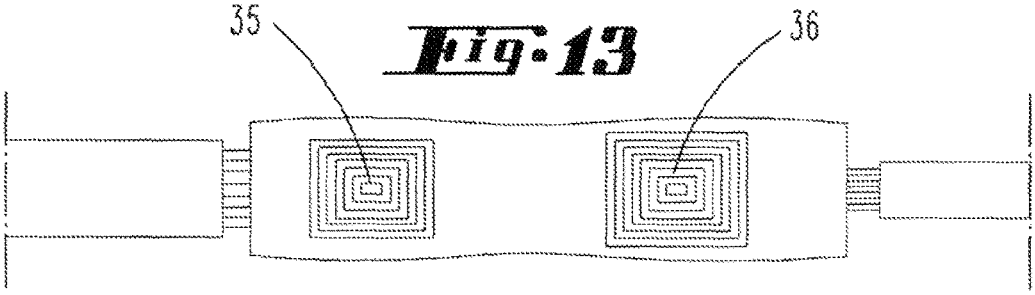
FIG. 13 shows a top view of the crimped compression sleeve according to FIG. 12.

FIGS. 11-13 show a compression sleeve 33 prior to a crimping operation, wherein FIG. 11 shows the compression sleeve in its initial state. The compression sleeve 33 is realized in the form of a tubular part with constant diameter.

Cables 31 and 34 with larger and smaller diameters are inserted into the compression sleeve 33 from two opposite sides as shown. A significant radial clearance obviously exists between the cable 34 and the inner surface of the compression sleeve 33. Cables of this type may consist of copper or aluminum cables. It is furthermore preferred that each cable is composed of a plurality of strands.

The different diameters may be based on various conventional cable cross sections. For example, the pairing (large/small) may respectively have proportions of 35 $mm^2$ to 16 $mm^2$, 95 $mm^2$ to 16 $mm^2$, 185 $mm^2$ to 70 $mm^2$ or 120 $mm^2$ to 95 $mm^2$, but other variations such as, for example, 70 $mm^2$ to 16 $mm^2$, 120 $mm^2$ to 95 $mm^2$, etc., would also be conceivable.

It is essential that two die impressions 35, 36 are produced adjacent to one another over a length L of the compression sleeve 33, wherein said die impressions are approximately identical as shown in FIG. 13. This is caused by different compressive forces acting upon the cable 31 of larger cross section on the one hand and the cable 34 of smaller cross section on the other hand during the crimping operation.

According to FIG. 12, a significant deformation of the compression sleeve respectively takes place in the region of the die impressions 35, 36, but the compression sleeve is not destroyed.

Due to the preferred utilization of a crimping device of the above-described type, the lower or higher compressive force is also automatically adjusted as a function of the crimped conductor with larger or smaller cross section.

The preceding explanations serve for elucidating all inventions that are included in this application and respectively enhance the prior art due to the following combinations of characteristics, namely:

A hydraulically actuatable crimping device, which is characterized in that the hydraulic piston 20, 22 consists of a first and a second partial piston 20, 22 with a first and a second partial application face, in that the partial application faces can be acted upon with hydraulic medium that has the same hydraulic pressure, and in that both partial pistons 20, 22 are respectively connected to a first and a second crimping part.

A hydraulic crimping device, which is characterized in that the partial pistons 20, 22 are guided inside of one another in a telescoping fashion.

A hydraulic crimping device, which is characterized in that the first partial piston 20 forms a second hydraulic cylinder for the second partial piston 22.

A hydraulic crimping device, which is characterized in that the second crimping part 27 can be acted upon with both partial pistons 20, 22 over part of the traveling distance, wherein the second partial piston 22 preferably can be displaced farther forward than the first partial piston 20 referred to the first hydraulic cylinder 17.

A hydraulic crimping device, which is characterized in that the size of the partial application faces differs, wherein the first partial application face is preferably smaller than the second partial application face.

A hydraulic crimping device, which is characterized in that both partial pistons 20, 22 are respectively acted upon with a first 21 and a second pull-back spring 23.

A hydraulic crimping device, which is characterized in that the crimping part 24, 27 consists of a crimping die.

A method for carrying out a crimping operation, which is characterized in that the compressive force, which can be exerted by the crimping part 24, 27, is predefined as a function of a position of the crimping part 24, 27 along the traveling distance, namely in such a way that a maximum compressive force is only exerted by the crimping part 24, in a final crimping position within a first partial traveling distance and a partial compressive force, which is lower than the maximum compressive force, is exerted in a final crimping position within a second partial traveling distance that follows the first partial traveling distance.

A method, which is characterized in that the completion of a crimping action is defined by reaching a predetermined pressure of the hydraulic medium acting upon the hydraulic piston 20, 22, wherein the same maximum pressure is preferably exerted upon an effective application face of a piston acting upon the crimping part 24, 27 irrespective of whether a final crimping position is reached in the first or the second partial traveling distance.

A method, which is characterized in that the compressive force is controlled by varying the effective application face of the piston.

A method for producing an electroconductive compression joint, which is characterized in that the compression sleeve 33, which has a constant inside diameter over its length, is in two opposite regions referred to a longitudinal direction of the compression sleeve crimped to the cables with different diameters by twice acting upon the compression sleeve 33 from outside with the same die, but with a different compressive force, namely at locations that lie adjacent to one another over the length of the compression sleeve and are respectively assigned to an end region of the cable with larger diameter and an end region of the cable with smaller diameter.

An electroconductively crimped compression sleeve, which is characterized in that the cables have different diameters, in that the die impressions (35, 36) are identical, and in that the die impressions (35, 36) are produced in the compression sleeve with different depths, wherein a die impression assigned to the cable with smaller diameter is produced in the compression sleeve deeper than a die impression assigned to the cable with larger diameter.

A method for clamping a workpiece, which is characterized in that a first and a second clamping part are provided, and in that a first and a second partial piston are provided and can be displaced relative to one another in a telescoping fashion in a common hydraulic cylinder against the force of a respective pull-back spring, wherein the first partial piston in any case displaces the first clamping part in order to clamp the workpiece, wherein both partial pistons furthermore are displaced as far as a clamping position, which results in clamping of the workpiece, such that the second partial piston leads the first partial piston when the partial pistons are acted upon with hydraulic medium, and wherein the displacement of the partial pistons is stopped in the clamping position.

A hydraulic device, which is characterized in that a first and a second clamping part are provided, and in that a first and a second partial piston are provided and can be displaced relative to one another in a telescoping fashion in a common hydraulic cylinder against the force of a respective pull-back spring, wherein the first clamping part can in any case be displaced by the first partial piston in order to clamp the workpiece, wherein both partial pistons furthermore can be displaced as far as a clamping position, which results in clamping of the workpiece, such that the second partial piston leads the first partial piston when the partial pistons are acted upon with hydraulic medium, and wherein the displacement of the partial pistons can be stopped in the clamping position.

REFERENCE LIST

1 Crimping device
2 Handle region
3 Control switch
4 Accumulator
5 Working end
6 Crimping part
7 Counterstop element
8 Workpiece
9 First pivoting part
10 Second pivoting part
11 Pivot joint
12 Pivot joint
13 Device head
14 Electric motor
15 Gear
16 Pump
17 Hydraulic cylinder
18 Backflow valve
19 Hydraulic medium tank/chamber
20 First hydraulic piston
21 First pull-back spring
22 Second hydraulic piston
23 Second pull-back spring
24 First crimping part
25 Through-opening
26 Cylinder bottom part
27 Second crimping part
28 Stopping part
29 Cable lug
30 Receptacle space
31 Cable
32 Cable lug (small)
33 Compression sleeve
34 Cable
35 Die impression
36 Die impression
A Longitudinal cylinder axis
R Crimping space
a Diameter
b Diameter
c Distance
d Distance

The invention claimed is:

1. A handheld hydraulically actuatable crimping device comprising:

a hydraulic cylinder defining a longitudinal cylinder axis;

a pull-back spring mounted within the hydraulic cylinder;

a hydraulic medium within the hydraulic cylinder;

a hydraulic piston displaceable within the hydraulic cylinder between a starting position and an end position and coaxial to the longitudinal cylinder axis against the force of the pull-back spring, the hydraulic piston including a first partial piston having a first partial application face configured to generate a compressive force due to the action of the hydraulic medium under hydraulic pressure acting upon the first partial application face, a first crimping part connected to the first partial piston, a second partial piston having a second partial application face configured to generate a compressive force due to the action of the hydraulic medium under hydraulic pressure acting upon the second partial application face, the first and second partial application faces being acted upon with the hydraulic medium with the same hydraulic pressure from the starting position to the end position, and a second crimping part connected to the second partial piston; and a stop provided in the hydraulic cylinder, wherein the second crimping part can be acted upon with both partial pistons over a first traveling distance that is defined by a displacement of the first and second partial pistons from the starting position to a point where the first partial piston contacts the stop, and wherein the second crimping part can further travel at a second traveling distance after completion of the first traveling distance when the second crimping part is further acted upon by the second partial piston without further moving the first partial piston.

2. The crimping device according to claim 1, wherein the first and second partial pistons telescope relative to each other.

3. The crimping device according to claim 1, wherein the first partial piston forms a second hydraulic cylinder for the second partial piston.

4. The crimping device according to claim 1, wherein the first partial application face defines a first size, and the second partial application face defines a second size, wherein the first size is smaller than the second size.

5. The crimping device according to claim 1, wherein the pull-back spring comprises a first pull-back spring and a second pull-back spring, wherein the first partial piston is acted upon by the first pull-back spring and the second partial piston is acted upon by the second pull-back spring.

6. The crimping device according to claim 1, wherein the first and second crimping parts comprise a crimping die.

7. The crimping device according to claim 1, wherein the first crimping part defines an outermost radial extent and the second crimping part defines an outermost radial extent which is radially outwardly of the outermost radial extent of the first crimping part.

8. A method configured to produce an electroconductive compression joint comprising:

providing a compression sleeve, the compression sleeve having a constant inside diameter over its length;

providing a crimping device, the crimping device comprising a hydraulic cylinder defining a longitudinal cylinder axis, a hydraulic medium within the hydraulic cylinder, a first partial piston having a first partial application face configured to generate a compressive force due to the action of the hydraulic medium under hydraulic pressure acting upon the first partial application face, the first partial application face defining a first size, a first crimping part connected to the first partial piston, a second partial piston having a second partial application face configured to generate a compressive force due to the action of the hydraulic medium under hydraulic pressure acting upon the second partial application face, the second partial application face defining a second size, and a second crimping part connected to the second partial piston, the first size being smaller than the second size, the hydraulic cylinder having a stop;

providing a first cable and a second cable, each cable having a diameter, wherein the first cable has a smaller diameter than the diameter of the second cable;

crimping an end region of the first cable with a first compressive force to a first location of the compression sleeve using the crimping device by moving the second crimping part over a first traveling distance that is defined by a displacement of the first and second partial pistons from an initial position to a point where the first partial piston contacts the stop, wherein the first and second partial pistons are acted upon by the hydraulic medium having the same hydraulic pressure;

crimping an end region of the second cable to a second location of the compression sleeve using the crimping device by moving the second crimping part over the first traveling distance and further by moving the second crimping part over a second traveling distance by only moving the second partial piston without moving the first partial piston, the second location being adjacent to the first location over the length of the compression sleeve;

wherein the first compressive force is lower than the second compressive force; and wherein the first and second cables are crimped to the sleeve at locations that lie adjacent to one another over the length of the compression sleeve.

9. A method configured to clamp a workpiece comprising:

providing a hydraulic crimping device comprising a hydraulic cylinder, hydraulic medium within the hydraulic cylinder, a first clamping part in the hydraulic cylinder, a second clamping part in the hydraulic cylinder, a first partial piston in the hydraulic cylinder and connected to the first clamping part, a second partial piston in the hydraulic cylinder and connected to the second clamping part, a first pull-back spring in the hydraulic cylinder and configured to act on the first partial piston, a second pull-back spring in the hydraulic cylinder and configured to act on the second partial piston, the first and second partial pistons configured to be displaced relative to one another in a telescoping fashion in the hydraulic cylinder against the force of the pull-back springs to move the first and second clamping parts;

simultaneously moving the first and second partial pistons and the first and second clamping parts by acting on the partial pistons with hydraulic medium wherein the second clamping part is moved telescopically ahead of the first clamping part to a clamping position to clamp the workpiece, and wherein only the second clamping part contacts the workpiece in the clamping position; and stopping the partial pistons in the clamping position;

wherein the second clamping part and the second partial piston elastically yield or elastically follow the workpiece during a movement of the workpiece due to the connection of the second clamping part to the first and second partial pistons and as a result of a pressure compensation which takes place via the hydraulic medium because the first partial piston springs back under action of its pull-back spring.

* * * * *